US006058561A

United States Patent [19]

Song et al.

[11] Patent Number: 6,058,561

[45] Date of Patent: May 9, 2000

[54] VACUUM CLEANER SUCTION APPARATUS

[75] Inventors: Jeong-Gon Song; Jang-Keun Oh, both of Kwangju, Rep. of Korea

[73] Assignee: Samsung Kwangju Electronics Co., Ltd., Kwangju, Rep. of Korea

[21] Appl. No.: 08/975,122

[22] Filed: Nov. 20, 1997

[30] Foreign Application Priority Data

Jun. 25, 1997 [KR] Rep. of Korea ..... 97-27352

[51] Int. Cl.[7] ..... A47L 9/04

[52] U.S. Cl. ..... 15/387; 15/375; 15/383

[58] Field of Search ..... 15/363, 383, 387, 15/375, 376

[56] References Cited

U.S. PATENT DOCUMENTS 463,236 11/1891 Schaeffer .

1,507,317 9/1924 Laberge .

2,052,129 8/1936 Campbell .

*Primary Examiner*—Terrence R. Till

*Assistant Examiner*—Jennifer C. McNeil

*Attorney, Agent, or Firm*—Perman & Green, LLP

[57] ABSTRACT

The present invention relates to a vacuum cleaner suction apparatus comprising an upper cover connected to a lower cover which has a void for installation of a rotary brush with a plurality of rotary vanes along a rotary shaft, first and second diaphragms with grooves at both sides of the void and a third diaphragm to form a duct over the second diaphragm and a certain shape of an air inlet between the lower cover and the first diaphragm to infuse outside air, thereby improving the suction efficiency of transporting the dust and foreign objects sucked through an air inlet, the void and a connecting pipe and thereby simplifying the number of parts and improvement of productivity as the rotary brush is driven by suction force of outside air and turning effect of the rotary vanes.

3 Claims, 5 Drawing Sheets

VACUUM CLEANER SUCTION APPARATUS

BACKGROUND OF THE INVENTION

1. Field of the Invention

The present invention relates to a vacuum cleaner designed to clean dust and foreign objects by way of instant suction of air via mechanical means, and more particularly to a vacuum cleaner suction apparatus to improve a suction efficiency of dust and foreign objects and to minimize production costs by reducing the number of parts.

2. Description of the Prior Art

In general, a vacuum cleaner comprises, as shown in FIG. 1, a suction apparatus(100) to suck dust and foreign objects by suction force, transporting means(200) to move the sucked dust into a collecting zone and subsequently into a main body(300) for accumulation of the transported dust.

The suction apparatus(100) comprises a dust detecting light(110), transporting wheels(120) at both sides and a connecting pipe(130) on the rear upper end. The transporting means(200) is inserted for a first and a second plastic extension pipes(210, 220) connected to the hollow part of the connecting pipe(130). There are two switches, one for air velocity control and the other for power control, at a handle control part(230) which is connected with the extension pipes(210, 220) and a flexible hose. The main body(300) includes a hose connector(310) for the end of the hose(240), a dust signal(320) to indicate the amount of accumulated dust, two wheels(330) at both sides, and a transporting handle(340) to allow a worker to move the vacuum cleaner around to new places to be cleaned.

The suction apparatus(100) is described in detail with reference to FIGS. 2 and 3, wherein the apparatus includes an upper cover(10) with a rectangular slot at one side, a lower cover(30) to be connected to the upper cover(10), a turbine(50) with its protruder being rotated by suction force of the air sucked through the connecting pipe(130), a rotary brush(60) with protruders(61) at its both sides being connected to the turbine and a belt(70) for simultaneous rotation, a shutter(81) to control the amount of air to be sucked through the connecting pipe(130) and a controlling lever(80) with a control handle(82).

At this location, the lower cover(30) includes a first diaphragm(31) with a groove(31*a*) for the turbine(50) and a second diaphragm(32) with two grooves, one(32*a*) for the turbine and the other(32*b*) for one end of the rotary brush (60), a third diaphragm(33) with a groove(33*a*) for the other end of the rotary brush(60), a void(34) for the controlling lever(80) and a void(35) between the second and the third diaphragms(32, 33) to put the rotary brush(60).

The belt(70) is to connect an end of the protruder(51) of the turbine(50) to that of the rotary shaft(61). As shown in FIG. 4, the control lever(80) includes a handle(82) which is protruded out of the rectangular slot(11) of the upper cover (10) when the upper and lower covers are combined.

Next, the overall operating sequence of the conventional suction apparatus is described with reference to FIGS. 1 and 4. When the main body(300) is rendered operative by supply of electric power, a motor(not shown) in the main body is rotated at a high speed, and thus outside air is sucked into the main body(300) through the suction apparatus(100) and the transporting means(200). The dust and foreign objects sucked into the main body(300) are collected and accumulated into a dust collector after passing through a filter, whereby the cleaning operation can be finished according to an operator's selection.

The air suction force generated by rotation of the motor is controlled by the velocity control switch attached in a handle control part(230) and a control lever(80) shown in FIGS. 3 and 4. Therefore, the amount of air to be sucked into the connecting pipe(130) is controlled by opening or closing an air suction channel with a shutter(81) connected to the control lever(80).

It has been found that the suction efficiency of dust and foreign objects by the turbine(50) is reduced in the conventional suction apparatus(100) since the protruder(51) disposed at only one side of the turbine(50) is placed between the first and second diaphragms(31, 32) and since the turbine(50) is installed between the connecting pipe(130) and the air suction channel.

Due to installation of the turbine(50) between the connecting pipe(130) and the suction channel in FIG. 3, almost all the dust and foreign objects infused into the void(35) of the lower cover(30) are transported, regardless of the location of the turbine, along an arrow direction (shown as K) and thus sucked into the connecting pipe(130) in case the shutter(81) of the control lever(80) is completely open; on the other hand, dust and foreign objects are to be trapped in the turbine(50) without being transported along an arrow direction (K) in case the shutter(81) is not completely open, thereby causing incomplete suction of dust and foreign objects into the connecting pipe(130).

SUMMARY OF THE INVENTION

The present invention is disclosed to solve the aforementioned problems and it is an object of the present invention to provide a vacuum cleaner suction apparatus disposed in a rotary brush with a plurality of rotary vanes via rotary shaft for sucking into a connecting pipe all the dust and the foreign objects along with the air by way of trurning effect of the rotary brush rotated at a high speed during vacuum cleaning to thereby improve a suction efficiency.

In accordance with the objects of the present invention, there is provided a vacuum cleaner suction apparatus, the apparatus having a rotary brush disposed in a void formed at a lower cover and coupled by the lower cover and an upper cover for sucking dust and foreign objects during vacuum cleaning, the apparatus comprising a structure disposed inside the rotary brush via a straightly-formed rotary shaft with a plurality of rotary vanes.

In accordance with another object of the present invention, there is provided a vacuum cleaner suction apparatus, the apparatus comprising a lower cover integrally formed at both sides of a groove with a first diaphragm member and a second diaphragm member for forming a rotary brush accommodation void, wherein the second diaphragm member is integrally formed with a third diaphragm for forming a duct thereon, and an air inlet is formed at a place where the first diaphragm and the lower cover join.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 4:
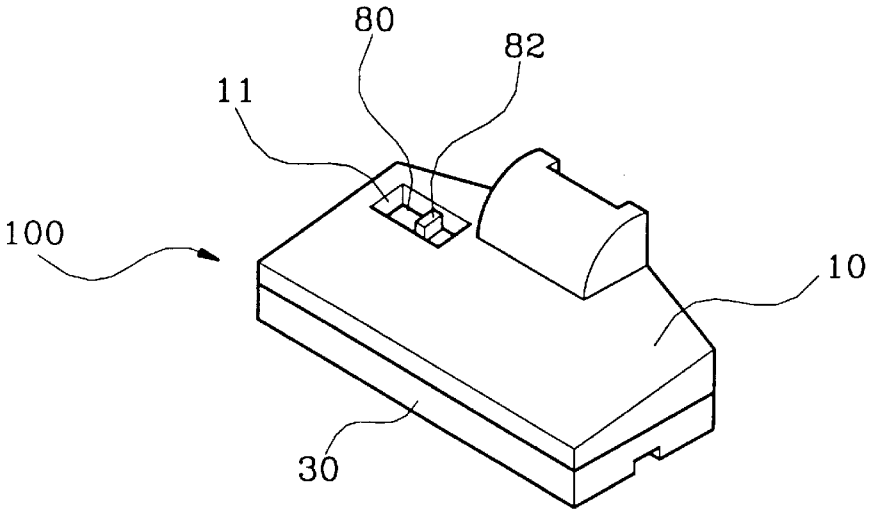
FIG. 4 PRIOR ART
FIG. 4 is a perspective view for illustrating an overall appearance of a conventional suction apparatus.
Figure 5:
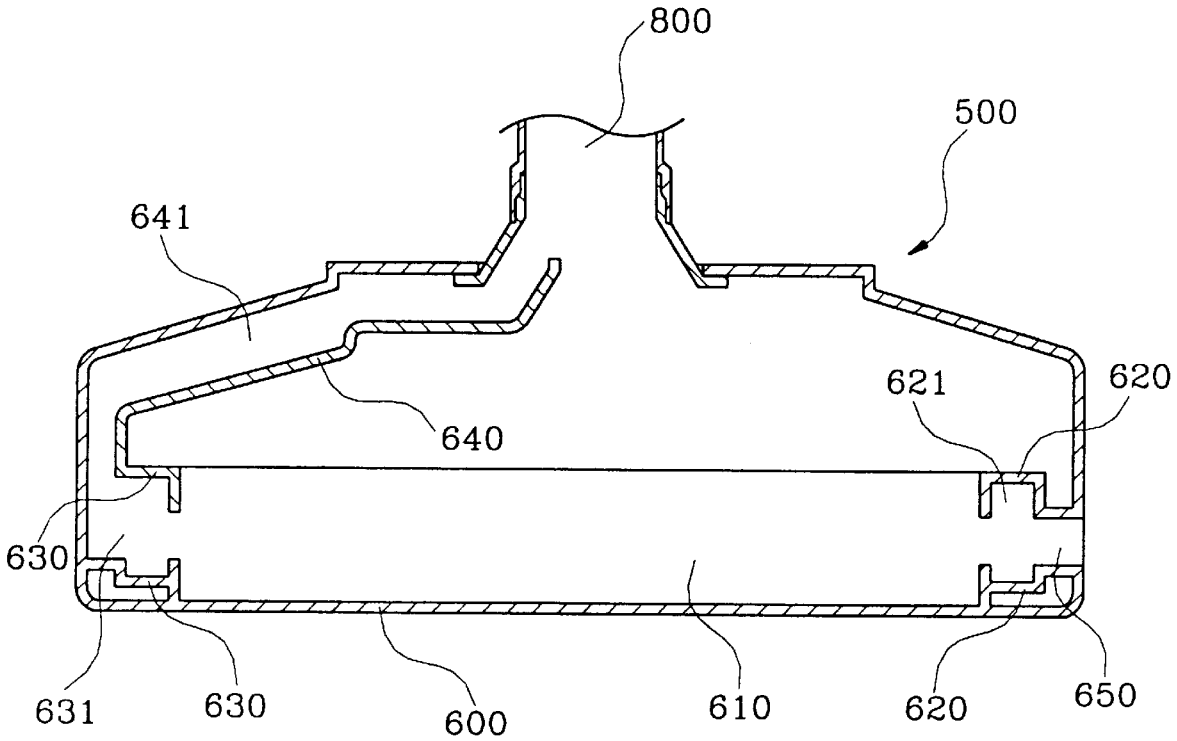
FIG. 5 is a longitudinal sectional view of a lower cover in accordance with the present invention.
Figure 6:
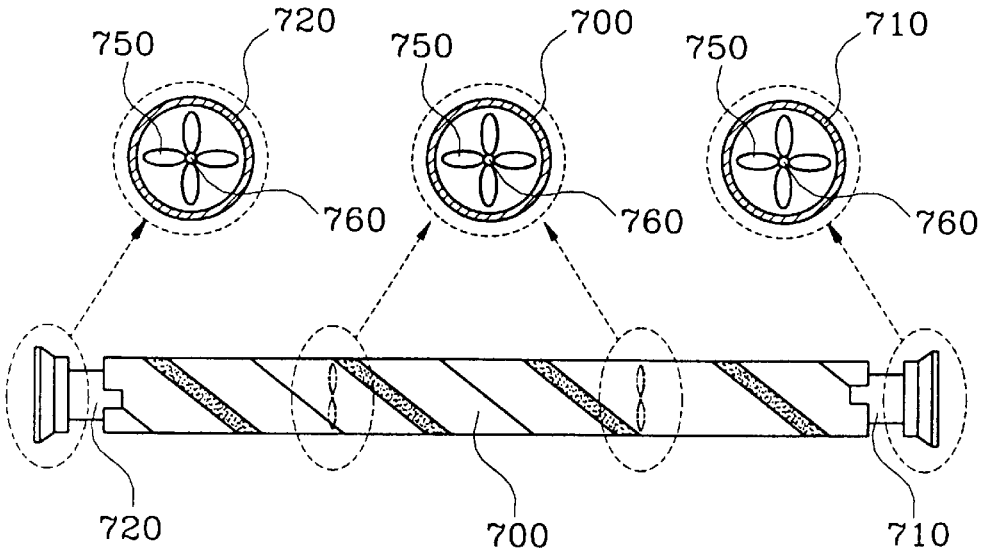
FIG. 6 is an elevation for showing an installation state of rotary vanes in a rotary brush.

The present invention is described in detail with reference to the accompanying drawings. FIG. 5 is a longitudinal sectional view of the lower cover while FIG. 6 is an elevation for showing an installation state of rotary vanes in a rotary brush. The suction apparatus(500) of the present invention is included between an upper cover(10 in FIG. 4) and a lower cover(600).

The lower cover(600) includes a void(610) for a rotary brush(700) to remove dust and foreign objects by suction force, first and second diaphragms(620 and 630) including grooves(621, 631) to put the protruders(710 and 720) of the rotary brush(700) at both sides of the void, a third diaphragm (640) to form the duct(641) being connected to the groove (631) of the rotary brush and the connecting pipe(800) over the second diaphragm(630) and a certain shape of air inlet(650) between the lower cover(600) and the first diaphragm(620) to suck outside air when suction force is generated by the motor (not shown).

On the other hand, a plurality of rotary vanes along a rotary shaft(760) are rotated in the rotary brush(700), which results in the improvement of the turning effect due to the suction force of the outside air infused from the air inlet (650).

Now, operation of the suction apparatus(500) in the present invention is described with reference to FIG. 7. When power is supplied to a main body(300) of the vacuum cleaner, the motor therein is rotated at a high speed, so that outside air is infused into the suction apparatus(500) through the air inlet(650) and the void(610). The air infused into the void(610) is sucked directly into the connecting pipe(800) along an arrow direction(M) whereas the air infused from the air inlet(650) is passed sequentially through inside of the rotary brush(700) and the duct(641) between the upper cover(600) and the third diaphragm(640) and into the connecting pipe(800) as shown as an arrow direction of N.

Once the air infused from the air inlet(650) is moved into the rotary brush(700), the rotary vanes(750) along the rotary shaft(760) are rotated at a high speed by the turning effect of the motor and suction force of the outside air infused from the air inlet(650). The dust and foreign objects are sucked in sequence into the suction apparatus(500), into the rotary brush(700) rotating at a high speed and then into the connecting pipe(800).

Figure 7:
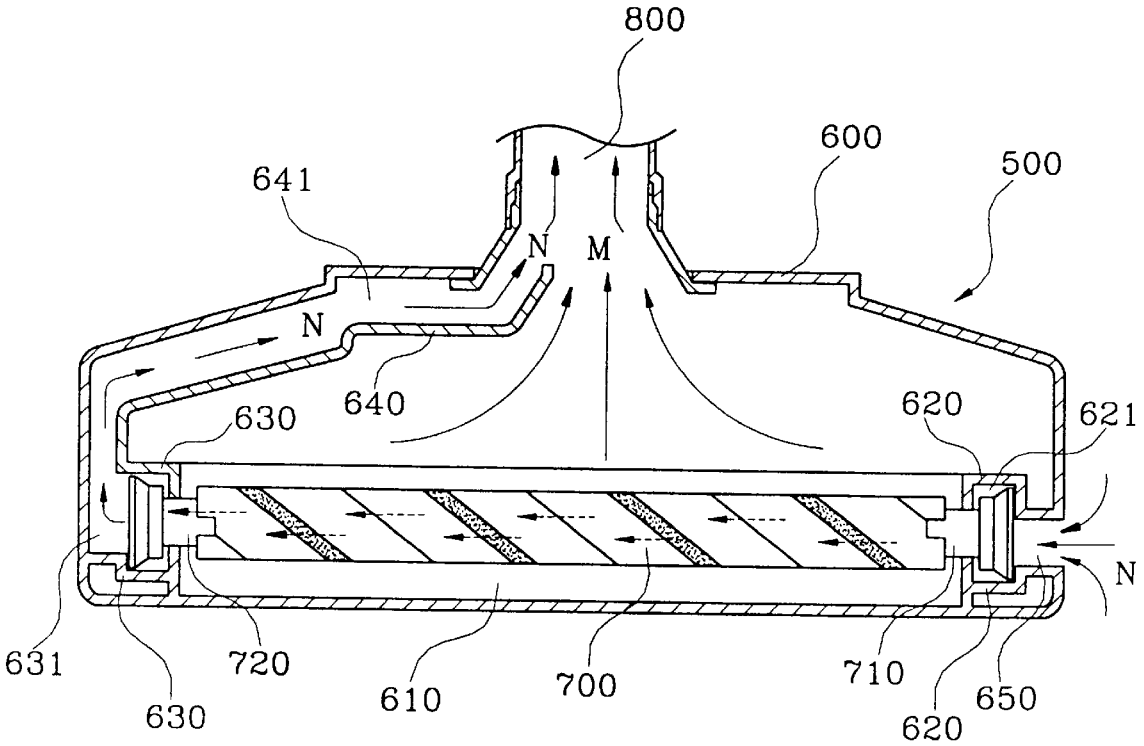
FIG. 7 is a sectional view for illustrating an installation state of a rotary brush in a lower cover.

Therefore, the suction apparatus(500) of the present invention in FIG. 7 is found to have a superior suction efficiency to the conventional one(100 in FIG. 3) in which the turbine(50) is installed between the connecting pipe(130) and the air suction channel and the suction rate is controlled by an opening or closing of the shutter(81) of the control lever(80).

Figure 1:
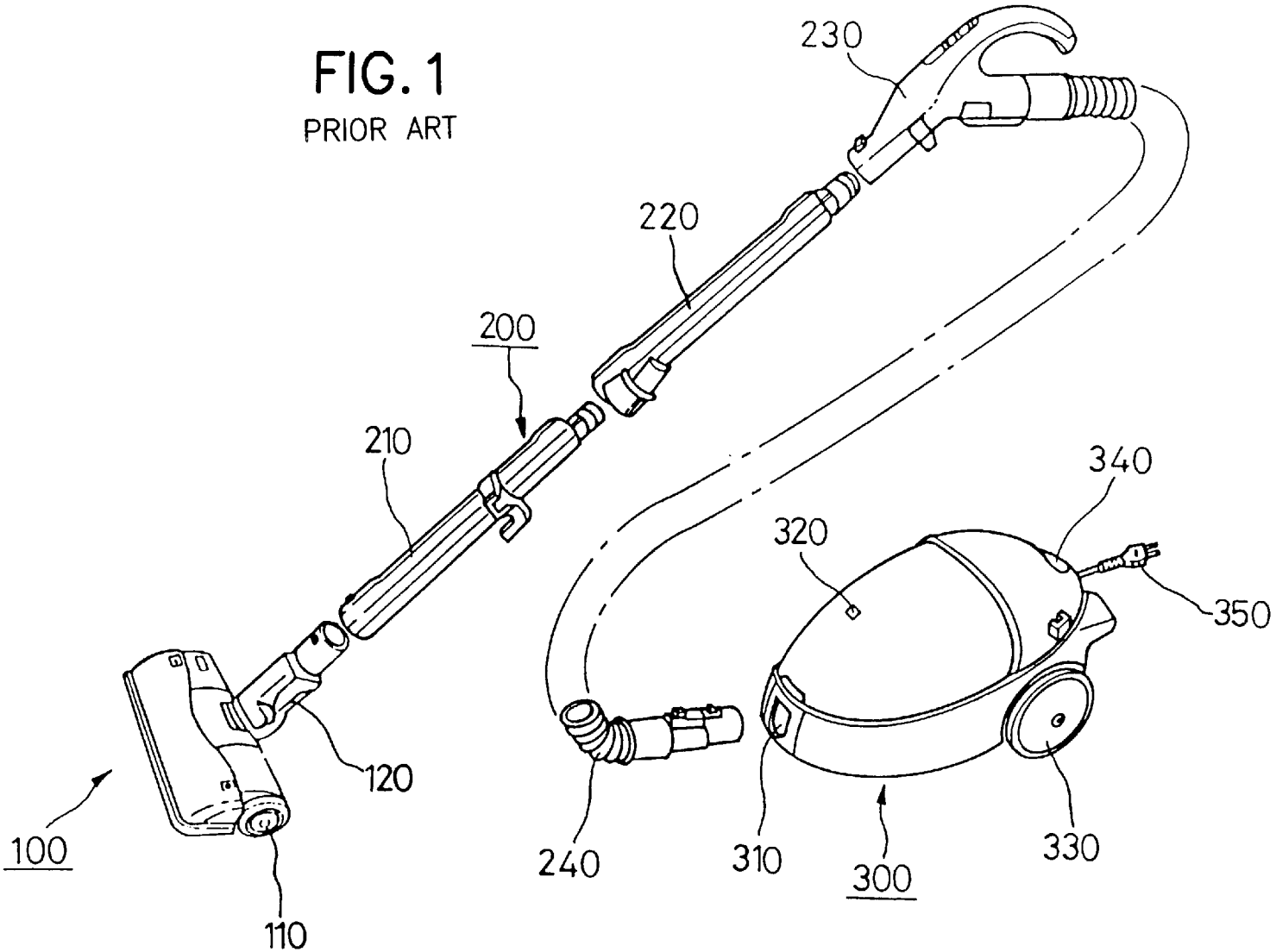
FIG. 1 PRIOR ART
FIG. 1 is a perspective view of a general vacuum cleaner.
Figure 2:
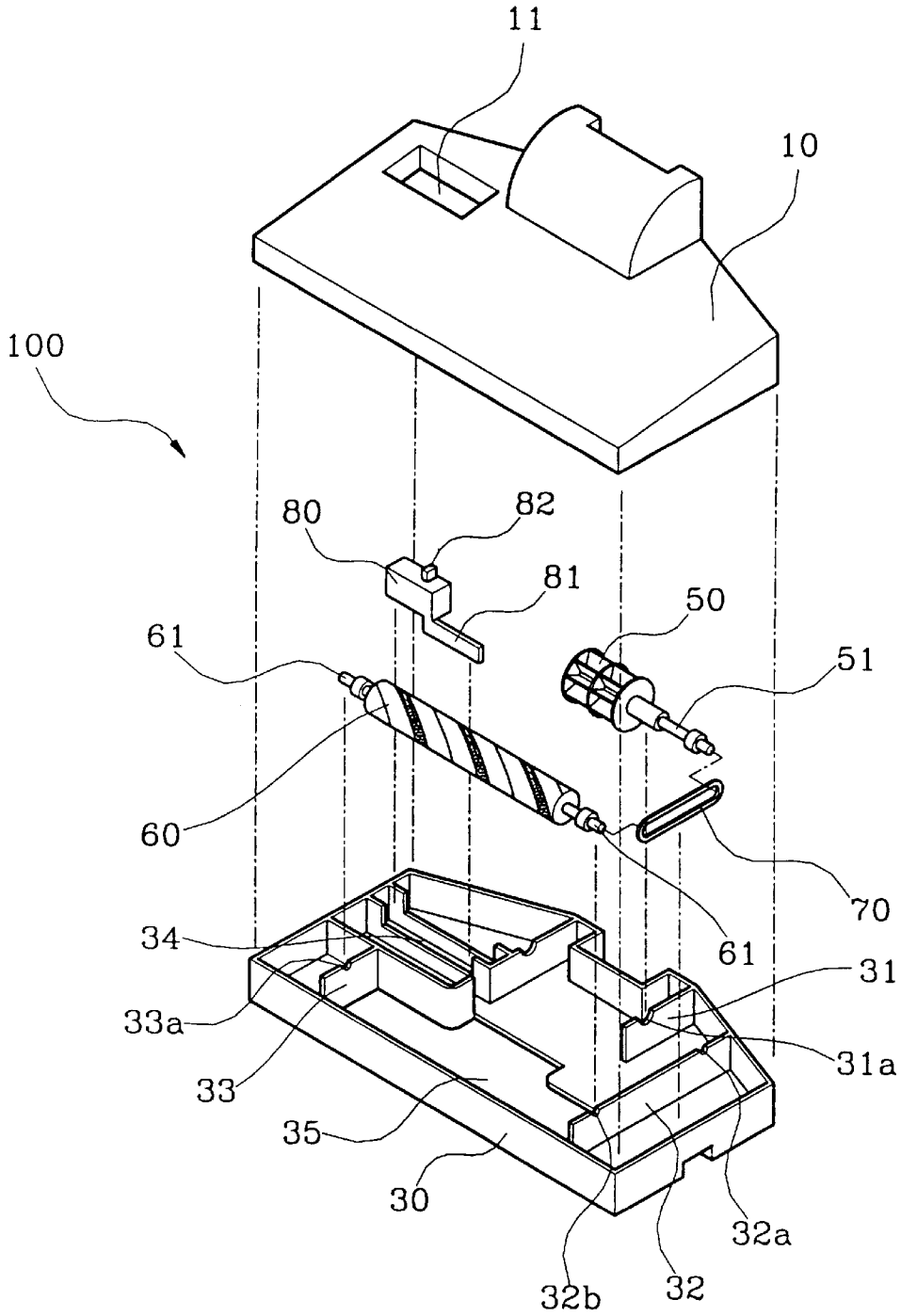
FIG. 2 PRIOR ART
FIG. 2 is a perspective view for illustrating the connection state of a conventional suction apparatus.
Figure 3:
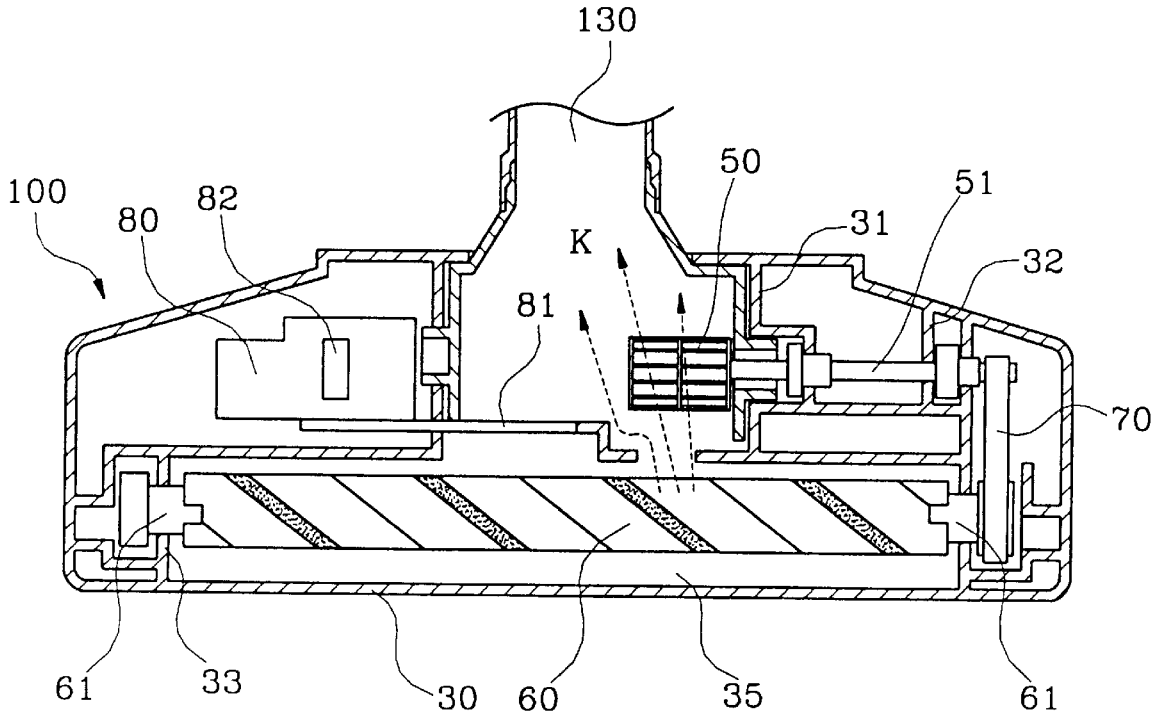
FIG. 3 PRIOR ART
FIG. 3 is a sectional view for illustrating the connection state of a conventional suction apparatus.

In addition, the rotary brush(700) of the suction apparatus (500) in the present invention is driven by suction force of the outside air infused through the air inlet(650) and turning effect of the rotary vanes(750), therefore reducing the number of the parts of the present invention in comparison with that of the conventional suction apparatus driven by the turbine(50) and the belt(70) in FIG. 3.

As described above, the rotary brush with a plurality of rotary vanes along a rotary shaft is installed in the void by way of the first and second diaphragms, and the dust and foreign objects from the rotary brush are completely infused into the connecting pipe, thereby improving a suction efficiency. The rotary brush is driven by suction force of the outside air infused from the air inlet and turning effect of the rotary vanes, resulting in simplification of the number of parts and improvement of productivity.

What is claimed is:

1. A vacuum cleaner suction apparatus, the apparatus having a rotary brush disposed in a void formed at a lower cover and coupled by the lower cover and an upper cover for sucking dust and foreign objects during vacuum cleaning, the apparatus comprising inside the rotary brush via a straightly-formed rotary shaft means for rotating the rotary brush, wherein the means for rotating the rotary brush comprise a plurality of rotary vanes disposed on a straightly-formed rotary shaft located inside the rotary brush.

2. A vacuum cleaner suction apparatus as defined in claim 1, wherein the lower cover has a first diaphragm member and a second diaphragm member integrally formed in the lower cover, the first and second diaphragm members defining respective sides of a groove accommodating the rotary brush therein, wherein the second diaphragm member is integrally formed with a third diaphragm member of the lower cover such that the second and third diaphragm members form a duct in the lower cover, and wherein the lower cover has an air inlet extending through the first diaphragm member.

3. In a vacuum cleaner suction apparatus comprising an upper cover connected to a lower cover to form a void, the lower cover having a first aperture formed therein for sucking external air into the void, the suction apparatus having a rotary brush disposed at least partially in the first aperture, wherein the improvement comprises:

the lower cover having a second aperture formed therein for sucking external air into the apparatus, the second aperture being separate from the first aperture, and the rotary brush being coupled to the lower cover wherein external air sucked through the second aperture passes inside the rotary brush effecting rotation of the rotary brush, said rotary brush has vanes disposed inside the rotary brush and wherein external air passing inside the rotary brush effects rotation of the vanes thereby rotating the rotary brush.

* * * * *